US006715400B2

(12) United States Patent
Muth et al.

(10) Patent No.: US 6,715,400 B2
(45) Date of Patent: Apr. 6, 2004

(54) FLUID POWER OPERATIVE INSTRUMENTALITY

(75) Inventors: Andreas Muth, Kirchheim (DE); Jari Haajo, Tampere (FI)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 10/294,347

(22) Filed: Nov. 14, 2002

(65) Prior Publication Data

US 2003/0097923 A1 May 29, 2003

(30) Foreign Application Priority Data

Nov. 29, 2001 (EP) ..... 01128503

(51) Int. Cl.[7] ..... F15B 13/00
(52) U.S. Cl. ..... 91/54; 137/269; 137/884
(58) Field of Search ..... 91/54; 137/269, 137/596.17, 884

(56) References Cited

U.S. PATENT DOCUMENTS 4,348,942 A * 9/1982 Stoll ..... 91/54
6,397,880 B1 * 6/2002 Stoll et al. ..... 137/271

FOREIGN PATENT DOCUMENTS

| | | | |
|---|---|---|---|
| EP | 0955473 | A1 | 11/1999 |
| EP | 1059458 | A2 | 12/2000 |
| FR | 2545161 | A1 | 11/1984 |
| JP | 05010308 | | 1/1993 |
| WO | WO 01/77534 | A1 | 10/2001 |

* cited by examiner

*Primary Examiner*—Thomas E. Lazo
(74) *Attorney, Agent, or Firm*—Hoffmann & Baron, LLP

(57) ABSTRACT

A fluid power operative instrumentality having an electro-fluidic control unit, which is provided with a plurality of electrically activated control valves having 2/2 valve functions. On the control unit different operative units may be selectively mounted, the control valves being able to be operated by means of electronic control circuitry in a manner matching the mounted operative unit.

20 Claims, 1 Drawing Sheet

FLUID POWER OPERATIVE INSTRUMENTALITY

BACKGROUND OF THE INVENTION

The invention relates to a fluid powered operative instrumentality, which is fitted with an operative unit able to be controlled by an electro-fluidic control unit.

THE PRIOR ART

The German patent publication 20,105,448.5 (utility model) discloses a fluid power operative instrumentality constituting a fluid power parallel gripper. Such a parallel gripper possesses two operative elements in the form of fluid power drives, which are able to be actuated by controlled supply of fluid. As a rule operation is controlled by electrically operated control valves on the supply side. The control valves employed are adapted to the control functions to be performed as regards their type.

In the case of the known operative instrumentality the control valves are in the form of separate, external components. However, it would be conceivable to have the valves in the form of an electro-fluidic control unit constituting a direct component of the fluid power operative instrumentality. If in this manner operative instrumentalities with different operative units, that is to say for example different types of gripping tools, are needed, the design becomes highly complex owing to the use of suitably adapted control units. For reasons of space availability and costs it is possible for instance to combine 3/2, 5/2 the and/or 5/3 valve functions in a suitable fashion. Owing to their specific function they are always associated with a certain operative unit or, respectively, a certain set of movements, dependent on whether within the operative unit for example linear drives or rotary drives or indeed a different number of drives is employed. As a consequence of such inflexibility it is possible, in the case of an integrated design, for the control valves to be designed as a specifically adapted, permanent part of the operative instrumentality. This will apply furthermore even when for reasons of space there is a separation in space of the electro-fluidic control unit and the operative unit.

SHORT SUMMARY OF THE INVENTION

One object of the invention is to create a fluid power operative instrumentality, which possesses a flexible and highly economic design having only a small number of components.

In order to achieve these and/or other objects appearing from the present specification, claims and drawings, in the present invention a fluid power operative instrumentality comprises an electro-fluidic control unit which possesses a first assembly interface, and at least one interchangeable operative unit having at least one fluid power operative element and possessing a second assembly interface provided for releasable mounting on the first assembly interface, the control unit comprising a plurality of electrically activatable control valves each with a 2/2 valve function and which are provided for fluid control of the employed operative unit and are able to be operated by means of electronic control circuitry in a different respective manner adapted to each other in order to be able to operate operative units, which are alternatively coupled with the control unit, having different types of fluid power customization.

This means that there is the possibility of designing a fluid power operative instrumentality maintaining a standardized form of electro-fluidic control unit if necessary with different operative units, which are different as regards their fluid power customization. The control unit and the operative units are admittedly able to be permanently connected together by way of matching assembly interfaces, but however are functionally decoupled from one another. Owing to the electronic control circuitry present and the standardized design of the control unit with a plurality of control valves each having a 2/2 valve function optimized adaptation, as regards the control technique, to the respectively mounted operative unit is possible. There is as it were a separation between an adaptable control valve group and operative units with an application-related customization. Within the control unit adaptable and preferably freely programmable functional arrays may be built up from a maximally compacted multiple arrangement of control valve units having an identical basic function, which may also be pilot controlled, in conjunction with operative units which are different as regards application and which already comprise the function defining linking of fluid ducts (but not however the associated control valves) necessary for their operation.

Although the patent publication WO/58859 A1 does disclose a micro-valve arrangement comprising an electro-fluidic control unit and equipped with electronic control circuitry and a plurality of 2/2 control valves, there is no provision for coupling with a controlled operative unit. Even if one were to consider fitting an operative unit directly with such known micro-valve arrangement, it would be necessary in addition to have a respectively specific, individual linking of the fluid ducts present. Such a measure is however unnecessary in the case of the operative instrumentality in accordance with the invention, in the case of which the fluid duct system defining function and specifically adapted to one operative unit, belongs to the fluid power design of the respective operative unit and is permanently customized so that circuit measures which may be changed as regards fluid ducts are not necessary.

Further advantageous developments of the invention are defined in the claims.

The operative units provided for operation with the control unit may at least partially constitute tools, as for example mechanically or suction operated gripper tools or other tools, which are able to be employed for materials handling.

The electronic control circuitry may in principle be arranged externally of the electro-fluidic control unit, a particularly compact arrangement with short connections is however made possible by a design, in which the electronic control circuitry is designed in the form of a component of the control unit.

It is convenient for there to be a type-specific encoding means on the respective operative unit, such encoding corresponding to the respectively associated type of operative unit and predetermining the manner of operation, necessary for the control valves, i.e. the functional linking of the 2/2 basic functions of the valve.

Encoding of the operative units may also be employed for the correlation of sensor signals, if the operative units are provided with sensor means, which, when the first and second assembly interfaces are placed together, may transmit sensor signals as regards the operational state of the operative unit to the control unit and more especially to the electronic control circuitry.

The electronic control circuitry may be designed to produce different valve functionalities by the grouped linking of control valves. For instance, higher order valve functions could be produced by logical linking of individual 2/2 valve functions or however larger flow cross sections could thus be produced by parallel circuiting or pseudo-proportional valve functions by parallel circuiting and logical linking.

By way of the electronic control circuitry the switching state of the control valves may be adapted to suit the requirements of the respective operative unit in a flexible, specific fashion.

The electronic control circuitry preferably comprises a memory in which the data, relevant for the manners of operation necessary for the different operative units, of the control valves may be stored and retrieved as required. There is more particularly a provision such that the respectively mounted operative unit causes an automatic retrieval of the manner of operation data intended for it.

Further advantageous developments and convenient forms of the invention will be understood from the following detailed descriptive disclosure of embodiments thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
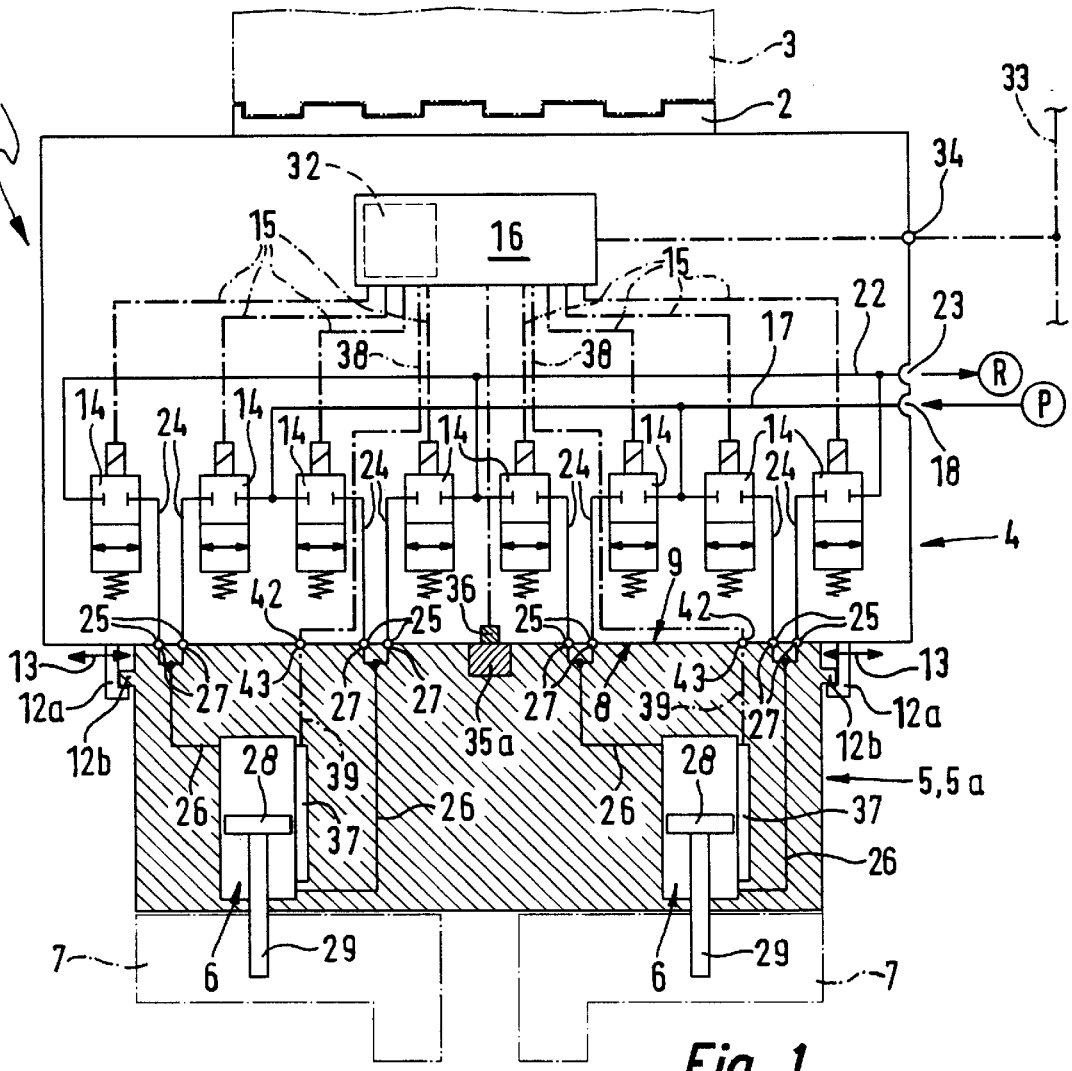
FIG. 1 is a diagrammatic representation of a partly sectioned lateral elevation of a preferred design of the fluid power operative instrumentality in accordance with the invention in a state involving a first type of a operative unit.

By way of example FIG. 1 shows one possible design of a fluid power operative instrumentality 1, which possesses attachment means 2 by way of which it is connected, more particularly in a detachable fashion, with a materials handling device 3 indicated in chained lines. By suitable operation of the handling device 3 the operative instrumentality 1 may be moved and positioned in the desired fashion.

Figure 2:
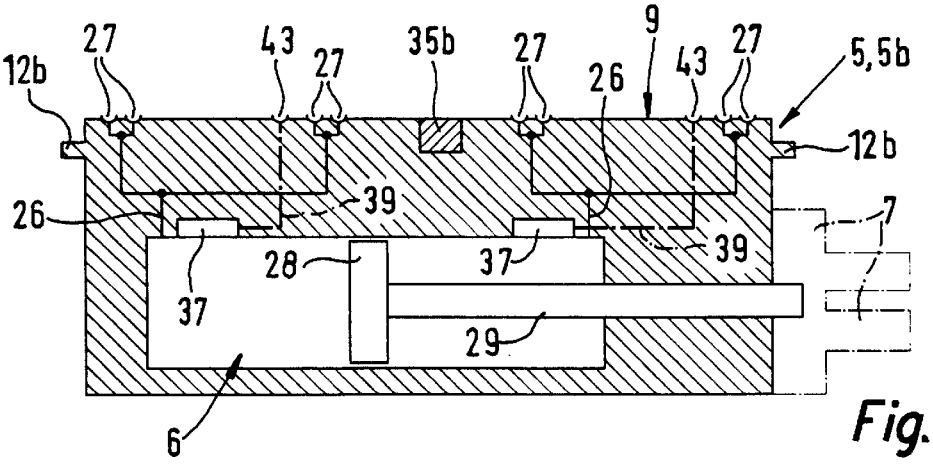
FIG. 2 is a separate elevation of a further type of a operative unit with which the operative instrumentality in accordance with FIG. 1 may be fitted in the alternative.

The operative instrumentality 1 comprises an electrofluidic control unit 4 and several operative units 5 attached in a detachable and accordingly interchangeable manner to the control unit 4. FIG. 1 shows the operative instrumentality 1 with a first operative unit 5 and 5*a* attached to it detachably. FIG. 2 shows a second operative unit 5 and 5*b* which may be coupled to the control unit 4 as an alternative to the first operative unit 5 and 5*a*.

The alternative units 5 comprise respectively at least one fluid power operative element 6*a*. In this respect it may for example be any type of drive 6, as is in fact the case with the embodiment. Rotary drives are possible for example. In the working example fluid power drives 6 in the form of linear drives are provided, that is to say in the specific case fluid power cylinders.

A first possible form of a fluid power drive element would be an ejector means. It may be employed for producing a vacuum, which for example serves for supplying suction elements, which may be utilized for holding objects to be handled. In this connection the operative unit 5 may also, given a suitable adaptation or customization, constitute a suction gripper.

One and the same operative unit may certainly be fitted simultaneously with a plurality of different operative elements 6*a*.

The first operative unit 5 and 5*a* is in the working example fitted with two fluid power drives 6 as operative elements 6*a*. The second operative unit 5 and 5*b* merely comprises one fluid power drive 6.

As a rule the operative units 5 are so designed that they respectively constitute a tool, as for example a handling tool. In the working embodiment illustrated the two operative units 5 are designed in the form of gripping tools. They comprise moving gripping means 7, as for example gripping jaws, which are indicated in chained lines in the drawing, and which respectively are drivingly connected with at least one drive 6 and by actuation of the drives 6 may for their part be operated. This means that there is for example the possibility of using the operative instrumentality 1 to take hold of any desired objects and moving them to some other position.

Other possible designs of tools are for example measuring, welding or checking means.

On one side, in the working example the bottom side, the control unit 4 possesses a first assembly interface 8. Another second assembly interface 9 complementary to it is provided on each of the operative units 5. The second assembly interfaces 9 of the individual operative units 5 are preferably identical.

For the attachment of an operative unit 5 on the control unit 4 the respective operative unit 5 has its second assembly interface 9 docked against the first assembly interface 8 of the control unit 4. This joined or docked together state is indicated in FIG. 1. At the two assembly interfaces 8 and 9 there is a convenient engagement of the two units over a wide contact area.

At the first assembly interface 8 the control unit 4, which for example is in the form of a block, possesses first attachment means 12*a*. Second attachment 12*b* complementary to same are located on a respective operative unit 5 adjacent to the second assembly interface 9. Owing to cooperation of the first and the second attachment means 12*a* and 12*b* it is possible for the docked operative unit 5 to be detachably connected with the control unit 4. In the working embodiment illustrated the first attachment means 12*a* are designed in the form of clamping means able to be moved in the direction of the double arrow 13.

The control unit 4 is provided with a plurality of electrically driven control valves 14. In this respect it may be a question of magnetic valves, piezoelectric valves or microvalves manufactured by micro-machining. On case of need same can be fitted with pilot valves. For their operation they are supplied with electrical actuating signals, which are supplied by way of electrical signal conductors 15, provided on the control unit 4, from electronic control circuitry 16.

The electronic control circuitry 16 is best designed in the form of a component of the control unit 4 and mounted on same or integrated in it. In contradistinction to an external arrangement, which is also possible, dimensions are smaller and paths of transmission shorter. A bus circuit for sensor and control signals is directly possible.

In the case of the control valves 14—in the working example there are eight thereof—it is a question of similar valves each having a 2/2 valve function. Each control valve 14 possesses an inlet and an outlet, between which, dependent on the position of switching, a fluid connection may be made or broken. It is preferably a question of switching valves.

The inlets of some of the control valves 14—in the working example of four of the control valves 14—are connected with a common supply duct 17, which leads to a supply connection 18 provided on the outer face of the control unit 4. This means that some of the control valves 14 are constantly subject to the action of a fluid, which is at the operational pressure above the atmospheric pressure. In the working embodiment compressed air is employed as the fluid. Hydraulic fluids would also be possible.

The inlets of the other control valves 14 are joined with a common relieving duct 22, which leads to a relieving connection 23 provided on the outer face of the control unit 4. In the case of the present pneumatic design of the operative instrumentality 1 the relieving duct 22 is a venting duct opening by way of the relieving connection 23 directly into the atmosphere. A fluid line for a channeled removal of the spent air or a muffler may be connected here.

The outlets of all control valves 14 communicate respectively with an individual first fluid duct 24, which leads along a predetermined, standardized path to the first assembly interface 8 where it opens at a first fluid connection 25.

By suitable operation of the individual control valves 14 the individual first fluid connections 25 may be supplied with operating fluid or vented. It is in this manner that the four states "operating pressure shut off", "atmospheric pressure shut off", "operating pressure acting" and "atmospheric pressure acting" may be produced at the first assembly interface 8. Furthermore the states "vacuum acting" and "vacuum shut off" are also possible, if there are suitable means for applying vacuum.

The fluid power drives 6 provided for each respective operative unit 5 are respectively connected with one or more second fluid ducts 26, which are permanently arranged on or in the respective operative unit 5 and lead to the second assembly interface 9, where they open at one or more second fluid connections 27. By way of the second fluid ducts 26 it is possible for operating fluid to be supplied or removed in order to operate the respectively connected drive 6 by fluid power.

The drives 6 of the working example are designed in the form of so-called double acting fluid power cylinders and each comprise a moving drive piston 28 arranged in a cylinder housing, which is kinematically linked with a piston rod or some other force output part 29 for movement therewith which in the working example can act on the gripping means 7.

The drive piston 28 divides up the interior of the cylinder housing into two working spaces, of which each has a fluid duct 26 extending from it, which, given a suitable design of the operative unit 5 (as for example in the case of operative unit 5*b*) may possess a branch.

The second fluid connections 27 are arranged on the second assembly interface 9 with the same pattern of distribution as the second fluid connections 25 on the first assembly interface 8. At least in the case of the working examples there is furthermore a provision such that each second fluid duct 26 of the operative unit 5 opens with at least two second fluid connections 27 at the second assembly interface 9, which are so associated with the first fluid connections 25 that the respective second fluid duct 26 is simultaneously connected with two control valves 14, of which the one can control the supply of the operating fluid and the other can control venting.

Thus there is the possibility, by way of example, of performing a 2/3 valve function by mutually matched operation of the two associated control valves 14. This possibility exists more especially in the case of the example of FIG. 1. If a second fluid duct 26 in accordance with FIG. 2 has at least one branch, it is possible for the second fluid duct 26 to open through more than two second fluid connections 27—for instance through four—at the second assembly interface 9 so that a connection is for example possible with four control valves 14 of the control unit 4, something which then permits still higher speeds of motion and/or special control functions (for instance a softstart and softstop). The production of 3/3 valve functions is also possible for example.

The operative units 5 of the operative instrumentality 1—the operative instrumentality of the working example comprises two operative units, but more than two operative units may readily be provided—differ, as already mentioned, in the fluid power adaptation. Thus the first operative unit 5*a* comprises two drives 6 whereas the second operative unit 5*b* has only one drive 6. Nevertheless it is possible for the operative units 5, despite their different types of fluid power adaptation, that is to say their different type, to be installed selectively on one and the same first assembly interface 8 of the control unit 4. All operative units 5 are permanently customized to be functionally specific as regards their respective fluid power adaptation. More particularly the routes and design of the second fluid ducts 26 are respectively specifically adapted to the respective type of operative unit 5, for instance taking into account the number and design of the fluid power drives 6 present.

One and the same control unit 4 may be employed in order to actuate the alternatively mounted operative units 5. The only necessary adaptation on the part of the control unit 4 resides in the suitably adapted activation of the control valves 14 by suitable control using the electronic control circuitry 16.

The electronic control circuitry 16 is in a position to send actuating signals to the control valves 14, this rendering possible a mutually adapted operation of the control valves 14 taking into account the specification of the respectively mounted operative unit 5. Thus, for example by grouped functional linking in of individual control valves 14 a variation in the valve functionality may be produced in order to for example to produce the above mentioned higher order valve functions and, for the purpose of increasing the flow rate, or to have parallel circuits and logical linking to obtain a pseudo-proportional behavior.

There is more particularly the provision that the electronic control circuitry 16 comprises a memory 32 in which the data for the manners of operation of the control valves 14 necessary for the different operative units 5 may be stored and retrieved. Then on changing the operative unit 5 it is merely necessary to retrieve the operational data necessary for the operative unit 5 currently mounted.

However there is also the alternative or additional possibility of supplying the necessary operational data and/or signals by way of an external field bus 33, which may be connected by way of a bus connection 34 provided on the control unit 4, with the electronic control circuitry 16.

The retrieval of the manner of operation data necessary for the respective operative unit 5 is preferably initiated automatically during or after mounting of a operative unit 5 on the control unit 4. For this purpose the individual operative units 5, 5*a* and 5*b* may possess type-specific encoding means 35*a* and 35*b* responsible for the retrieval of the operational data with the correct association.

The encoding means 35*a* and 35*b*, which for example are mechanical, optical or electronic, cooperate, when the operative unit 5 is installed, with identifying means 36 provided on the control unit 4 and which are connected with the electronic control circuitry 16 for signaling purposes.

The same mutually cooperating encoding means 35*a* and 35*b* and identification means 36 or additionally provided means, may also be employed in order to ensure that sensor signals (supplied by the mounted operative unit 5) are specifically processed in accordance with the type of the respectively mounted operative unit 5 by the control unit 4 and more especially the electronic control circuitry 16.

In the working embodiment each fluid power drive 6 is provided with sensor means 37, as for example position sensor means, connected by way of second sensor lines 39 of the respective operative unit 5 with second sensor connections 43 associated with the second assembly interface 9. The latter are connected, when the operative unit 5 is mounted, for signal transmission with first sensor connections 42, which are provided on the first assembly interface 8 and are connected by way of first sensor line 38 with the electronic control circuitry 16.

The electronic control circuitry 16 can take into account the sensor signals during controlled operation of the individual control valves 14.

Generally the operative instrumentality 1 taken as an example is characterized by an interface defined by the two assembly interfaces 8 and 9, which is responsible for a separation between specifically switched operative units 5 and the non-specific, variably linked multiple arrangement of identical 2/2 valve functions in the form of the control valves. The basic 2/2 valve functions may be combined together electronically in any desired fashion. The electronic control circuitry 16 preferably comprises a control program, which can control the control valves 14 in a manner specific to the operative units, more especially on the basis of data provided in a fashion specific to the operative units.

Within the control unit 4 a simple valve arrangement, for example a simple placement in a row of 2/2 control valves, is possible so that it is possible to do without complex valve designs. The valve functionalities available at the first assembly interface 8 available from the first fluid connections 25 there are produced simply by the mutually matched manner of operation of individual or multiple control valves 14.

The application specific linking of the operational state available at the first fluid connections 25, is supplemented within operative units 5 by means of the permanently set path of the second fluid ducts 26 to yield higher order switching functions. In this respect it is to be noted that in addition to the specific duct linking also additional function elements may be included, that is to say in addition to the above mentioned sensor means 37, for instance fluid power elements such as check valves, chokes and amplifiers or the like.

Owing to the interface present a distribution is possible into operative unit-specific and tool-specific areas, something which renders possible the use of a structurally identical but functionally programmable valve arrangement for different types of operative units 5.

Owing to the design as described it is possible for a single control unit 4 to be utilized multiply and with different types of operative units 5. Furthermore, there is the possible, in suitable cases of application, of providing the control unit 4 or, respectively, its control valves 14, outside the working area of the operative unit 5.

It is possible for readily adaptable, freely programmable functional patterns to be built up from a maximally compacted multiple arrangement of identical basic valve functions. The linking in an application-specific manner of the fluid duct then takes place within the operative units 5 and not in the control unit 4.

The arrangement of the ducts within the operative unit 5 may be produced in the form of conventional ducts or with the use of fluid lines. Furthermore, so-called integration technology may be employed, in the case of which the fluid ducts are at least partly defined by grooves, which are located in the interface between plates held together. This means that a specific logical linking of the second fluid ducts 26 may be produced in a particularly simple manner.

What is claimed is:

1. A fluid power operative instrumentality comprising an electro-fluidic control unit which possesses a first assembly interface, and at least one interchangeable operative unit having at least one fluid power operative element and possessing a second assembly interface provided for releasable mounting on the first assembly interface, the control unit comprising a plurality of electrically activatable control valves each with a 2/2 valve function and which are provided for fluid control of the employed operative unit and are able to be operated by means of electronic control circuitry in a different respective manner adapted to each other in order to be able to operate operative units, which are alternatively coupled with the control unit, having different types of fluid power customization.

2. The operative instrumentality as set forth in claim 1, wherein the operative units alternatively able to be mounted on the control unit are permanently pre-customized as regards their respective fluid power adaptation in a functionally specific manner.

3. The operative instrumentality as set forth in claim 1, wherein the operative units at least partially constitute tools such as materials handling means like mechanical grippers and suction grippers etc.

4. The operative instrumentality as set forth in claim 1, wherein the electronic control circuitry is designed in the form of a direct component of the control unit.

5. The operative instrumentality as set forth in claim 1, comprising type-specific encoding means provided on a respective component, such encoding means being adapted to predetermine the manner, necessary for the control valves, of operation of the electronic control circuitry when the first operative unit is mounted on the electronic control unit or during mounting such operative unit.

6. The operative instrumentality as set forth in claim 1, wherein the electronic control circuitry is designed to produce a grouped functional linking of the control valves and thus different valve functionalities, as for example higher order valve functions, parallel circuit arrangement or pseudo proportional valve function.

7. The operative instrumentality as set forth in claim 1, wherein the electronic control circuitry comprises a memory in which data relating to manners of operation necessary for the different operative units, of the control valves may be stored and retrieved.

8. The operative instrumentality as set forth in claim 7, comprising means for retrieval, automatically initiated by the respectively mounted operative unit, of the manner of operation data.

9. The operative instrumentality as set forth in claim 1, comprising first fluid connections provided on the first assembly interface and connected by way of first fluid ducts of the control unit with the control valves, such fluid connections being provided with second fluid connections arranged in the same distribution pattern, of the respectively mounted operative unit, which are connected by way of second fluid ducts of the operative unit with the at least one fluid operated operative element belonging to the operative unit.

10. The operative instrumentality as set forth in claim 1, wherein the control valves are connected by way of a fluid ducts having a permanently set standardized path with first fluid connections provided on the first assembly interface, such first fluid connections communicating with second fluid connections respectively provided at the second assembly interface of the respectively mounted operative unit, such fluid connections belonging to second fluid ducts of the mounted operative unit, which are designed in an application-specific means in accordance with the specific structure of the respective operative unit.

11. The operative instrumentality as set forth in claim 1, wherein each operative unit is provided with sensor means, which, when the first and the second assembly interfaces are mounted may transmit sensor signals to the assembly interface and more particularly to the electronic control circuitry.

12. The operative instrumentality as set forth in claim 11, wherein the electronic control circuitry is adapted to process the received sensor signals on the basis of an encoding means of the operative units in accordance with the type of the mounted operative unit.

13. The operative instrumentality as set forth in claim 1, comprising at least two operative units of different type, which may be selectively mounted on the control unit.

14. The operative instrumentality as set forth in claim 1, wherein a part of the control valves is arranged to be constantly subjected to vacuum or to an operating pressure above atmospheric pressure and another part of the control valves is provided for being constantly subjected to atmospheric pressure.

15. The operative instrumentality as set forth in claim 14, wherein a part of the control valves is connected with a supply duct and another part of the control valves is connected with a common relieving duct.

16. The operative instrumentality as set forth in claim 1, wherein the control valves are at least partially in the form of magnetic valves, piezoelectric valves or micro-valves.

17. The operative instrumentality as set forth in claim 1, comprising attachment means provided on the control unit and on each respective operative unit for the mutual mechanical connection in the mounted state.

18. The operative instrumentality as set forth in claim 1, comprising a bus connection connected with the electronic control circuitry for connection with a field bus.

19. The operative instrumentality as set forth in claim 1, wherein at least one operative element is constituted by a fluid power drive.

20. The operative instrumentality as set forth in claim 1, wherein at least one operative element is constituted by an ejector means serving for producing vacuum.

* * * * *

UNITED STATES PATENT AND TRADEMARK OFFICE

CERTIFICATE OF CORRECTION

PATENT NO. : 6,715,400 B2
DATED : July 7, 2004
INVENTOR(S) : Muth et al.

It is certified that error appears in the above-identified patent and that said Letters Patent is hereby corrected as shown below:

Column 8,
Line 26, now reads "as regards their respective…", and should read -- in regards to their respective… --.

Signed and Sealed this

Tenth Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,715,400 B2
DATED : July 7, 2004
INVENTOR(S) : Muth et al.

It is certified that error appears in the above-identified patent and that said Letters Patent is hereby corrected as shown below:

Column 8,
Line 26, now reads "as regards their respective…", and should read -- in regards to their respective… --.
Lines 31-32, now reads "such as materials handling means like mechanical grippers and suction grippers etc.", and should read -- such as material handling tools. --.
Line 46, now reads "valve functionalities, as for example higher order valve functions, parallel circuit arrangement or pseudo proportional valve function" and should read -- valve functionalities. --.

Signed and Sealed this

Twelfth Day of October, 2004

JON W. DUDAS
*Director of the United States Patent and Trademark Office*